US012760394B2

(12) United States Patent
Glazoff et al.

(10) Patent No.: US 12,760,394 B2
(45) Date of Patent: Oct. 13, 2026

(54) ALUMINUM ALLOYS AND RELATED METHODS AND ARTICLES

(71) Applicants: Battelle Energy Alliance, LLC, Idaho Falls, ID (US); Iowa State University Research Foundation, Inc., Ames, IA (US); ECK Industries, Inc., Manitowoc, WI (US); University of Tennessee Research Foundation, Knoxville, TN (US)

(72) Inventors: Michael V. Glazoff, Ammon, ID (US); Ryan T. Ott, Ames, IA (US); Feng Zhang, Ankeny, IA (US); Qiang Li, Chandler, AZ (US); Seungjin Nam, Ames, IA (US); Orlando Rios, Knoxville, TN (US); David J. Weiss, Manitowoc, WI (US)

(73) Assignees: Battelle Energy Alliance, LLC, Idado Falls, ID (US); Iowa State University Research Foundation, Inc., Ames, IA (US); ECK Industries, Inc., Manitowoc, WI (US); University of Tennessee Research Foundation, Knoxville, TN (US)

( * ) Notice: Subject to any disclaimer, the term of this patent is extended or adjusted under 35 U.S.C. 154(b) by 445 days.

(21) Appl. No.: 18/352,174

(22) Filed: Jul. 13, 2023

(65) Prior Publication Data

US 2024/0309494 A1 Sep. 19, 2024

Related U.S. Application Data

(60) Provisional application No. 63/368,315, filed on Jul. 13, 2022.

(51) Int. Cl.

| | |
|---|---|
| ***C22C 21/12*** | (2006.01) |
| ***B22D 11/00*** | (2006.01) |
| ***C22F 1/05*** | (2006.01) |
| ***C22F 1/057*** | (2006.01) |

(52) U.S. Cl.
CPC ..... *C22C 21/12* (2013.01); *B22D 11/003* (2013.01); *C22F 1/057* (2013.01)

(58) Field of Classification Search
CPC ..... C22F 1/04–1/057; C22C 21/00–21/18
See application file for complete search history.

(56) References Cited

U.S. PATENT DOCUMENTS

| | | | | |
|---|---|---|---|---|
| 11,608,546 | B2 | 3/2023 | Allard, Jr. et al. | |
| 2012/0152414 | A1* | 6/2012 | Che | B22F 1/105 148/438 |
| 2018/0291489 | A1* | 10/2018 | Mann | C22C 21/16 |
| 2020/0115777 | A1 | 4/2020 | Guo et al. | |

FOREIGN PATENT DOCUMENTS

| | | | |
|---|---|---|---|
| CA | 2729251 | C | 4/2014 |
| CA | 2997024 | A1 | 3/2017 |
| CA | 2812236 | C | 3/2018 |
| CN | 115323230 | A | 11/2022 |
| WO | 2011/032434 | A1 | 3/2011 |
| WO | 2019/055872 | A1 | 3/2019 |
| WO | 2020/052129 | A1 | 3/2020 |

OTHER PUBLICATIONS

Sugihara, Makoto, and Ichiro Tsuboya. "Structural and Magnetic Properties of Copper-Substituted Manganese-Aluminum Alloy." Japanese Journal of Applied Physics 2.7 (1963): 373.*

Czerwinski, Frank. "Cerium in aluminum alloys." Journal of materials science 55.1 (2020): 24 and .42-44.*

* cited by examiner

*Primary Examiner* — Jessee R Roe
(74) *Attorney, Agent, or Firm* — TraskBritt

(57) ABSTRACT

An aluminum alloy comprising aluminum, copper, cerium, and one or more of manganese and zirconium. The aluminum alloy comprises a copper:cerium ratio of about 2.0:1.0. Related methods of forming articles comprising the aluminum alloy and articles comprising the aluminum alloy are also disclosed.

17 Claims, 19 Drawing Sheets

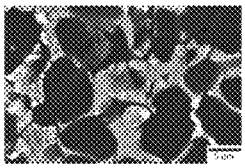
FIG. 3A1
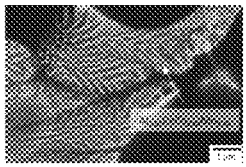
FIG. 3A2
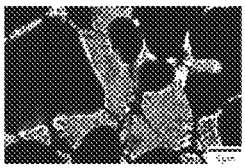
FIG. 3B1
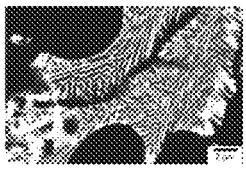
FIG. 3B2
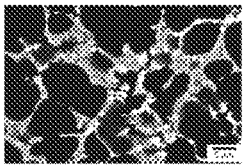
FIG. 3C1
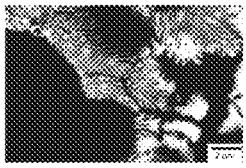
FIG. 3C2
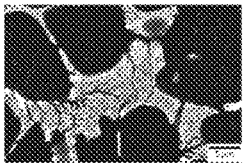
FIG. 3D1
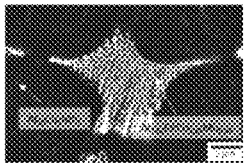
FIG. 3D2

ALUMINUM ALLOYS AND RELATED METHODS AND ARTICLES

CROSS-REFERENCE TO RELATED APPLICATION

This application claims the benefit under 35 U.S.C. § 119(e) of U.S. Provisional Patent Application Ser. No. 63/368,315, filed Jul. 13, 2022, the disclosure of which is hereby incorporated herein in its entirety by this reference.

STATEMENT REGARDING FEDERALLY SPONSORED RESEARCH OR DEVELOPMENT

This invention was made with government support under Contract Number DE-AC07-05-ID14517 and Contract Number DE-AC02-07CH11358, awarded by the United States Department of Energy. The government has certain rights in the invention.

TECHNICAL FIELD

This disclosure relates generally to aluminum alloys and forming the aluminum alloys. More specifically, the disclosure relates to alloys that include aluminum, copper, cerium, one or more of manganese and zirconium, and, optionally, scandium and to forming the aluminum alloys.

BACKGROUND

Aluminum alloys are used in the aerospace, automotive, and other industries for their high temperature resistance and mechanical properties. Aluminum alloys may be wrought into articles, such as rolled plates, sheets, or foils. Alternatively, aluminum alloys may be cast into articles. Cast aluminum alloys have lower tensile strength than wrought aluminum alloys.

BRIEF SUMMARY

An aluminum alloy is disclosed and comprises aluminum, copper, cerium, and one or more of manganese and zirconium. The aluminum alloy comprises a copper:cerium ratio of about 2.0:1.0.

A method of forming an aluminum article is disclosed and comprises combining aluminum, copper, cerium, and one or more of manganese and zirconium to form an aluminum alloy mixture. The aluminum alloy mixture is heated to form a molten aluminum alloy and the molten aluminum alloy is cast into a mold of an article.

An aluminum article is also disclosed and comprises an aluminum matrix and an intermetallic phase. The aluminum article exhibits a heterogeneous microstructure.

BRIEF SUMMARY OF THE DRAWINGS

FIGS. 3A1-3D2 are low-magnification and high-magnification back-scattered SEM micrographs of Al-6Cu-3Ce-1Mn-0.5Zr alloys according to embodiments of the disclosure;

DETAILED DESCRIPTION

Figure 1:
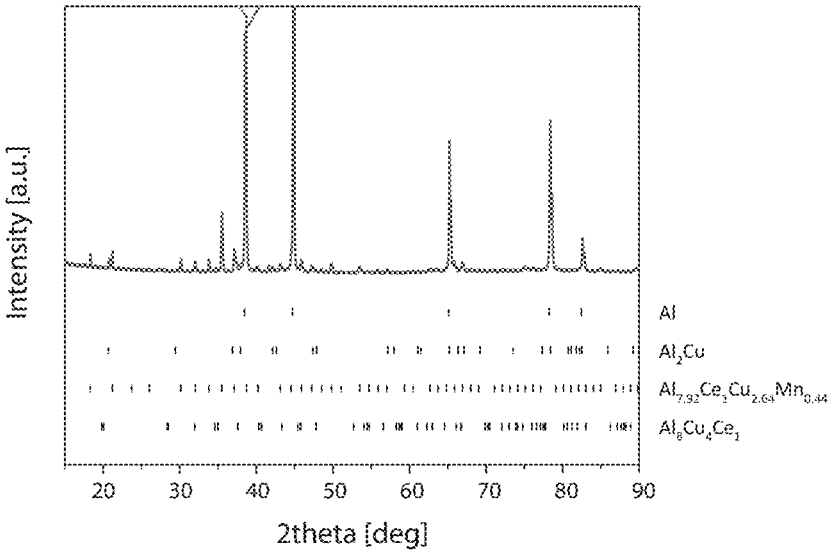
FIG. 1 are X-ray diffraction spectra of Al-6Cu-3Ce-1Mn-0.5Zr alloys according to embodiments of the disclosure.

An aluminum alloy having high temperature resistance, high corrosion resistance, and comparable or improved mechanical properties compared to conventional aluminum alloys is disclosed. The aluminum alloy may be a ternary composition, a quaternary composition, or a higher composition that includes aluminum, copper, cerium, and one or more of manganese and zirconium. The aluminum alloy may optionally include scandium. The aluminum, copper, and cerium may be primary ingredients (e.g., components) of the aluminum alloy. The aluminum may function as a matrix in the aluminum alloy and the cerium may function as a eutectic-forming element. The copper and manganese may also function as eutectic-forming elements. The zirconium may function as a dispersion hardener. The scandium, if present, may function as a dispersion hardener. The aluminum alloys exhibit improved castability and mechanical properties at temperatures greater than or equal to about 250° C., such as about 300° C. or about 350° C., which are not achievable using conventional aluminum alloys. The comparable or improved mechanical properties include one or more of bending strength (UBS), ultimate tensile strength (UTS), bending angle (γ), hardness (HB), yield strength (YS), and elongation (El) compared to conventional aluminum alloys, such as AA336 and/or AA319. The aluminum alloys may provide improved mechanical properties at temperatures at and above about 250° C. when compared to an aluminum alloy that uses copper as a primary alloying element.

The aluminum alloy may, alternatively, include aluminum, copper, manganese, zirconium, iron, magnesium, nickel, chromium, scandium, erbium, silicon, and cerium, lanthanum, and one or more of rare earth elements (REE).

The aluminum alloy may be formed (e.g., cast) into an article that is lightweight, has high temperature resistance and corrosion resistance, and comparable or improved mechanical properties when compared to conventional aluminum alloys. The aluminum alloy may be more castable (e.g., more easily cast) than conventional aluminum alloys, such as AA336 and/or AA319. The aluminum alloy according to embodiments of the disclosure may be cast at a temperature from about 750° C. to about 950° C. The article formed from the aluminum alloy may be used in a composite structure, such as in the automotive industry or in the aerospace industry. The article may be thermally stable, such as stable for use at a temperature of up to about 425° C. The article is formed and may be used without conducting a heat treatment act, such as without conducting a solution heat treatment and quench. However, the article may optionally be further strengthened by conducting a heat treatment act. The resulting article formed from the aluminum alloy according to embodiments of the disclosure exhibits minimal defects (e.g., minimal porosity and shrinkage).

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," "top," "bottom," "upper," "lower," "above," "beneath," "side," "upward," "downward," etc., is used for clarity and convenience in understanding the disclosure and accompanying drawings and does not connote or depend on any specific preference or order, except where the context clearly indicates otherwise.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

The aluminum alloy includes aluminum as the predominant component, such as containing greater than or equal to about 73.9% by weight (wt %) aluminum, greater than or equal to about 80 wt % aluminum, greater than or equal to about 85 wt % aluminum, greater than or equal to about 90 wt % aluminum, greater than or equal to about 95 wt % aluminum, or greater than or equal to about 98 wt % aluminum. The purity of the aluminum in the aluminum alloy may be at least about 99.7%.

The copper may be present in the aluminum alloy at less than or equal to about 15.0 wt %, such as from about 2.0 wt % to about 15.0 wt %, from about 2.0 wt % to about 10.0 wt %, from about 2.0 wt % to about 12.0 wt %, from about 2.0 wt % to about 14.0 wt %, from about 5.0 wt % to about 10.0 wt %, from about 5.0 wt % to about 15.0 wt %, or from about 10.0 wt % to about 15.0 wt %. The purity of the copper in the aluminum alloy may be at least about 99.9%.

The cerium may be present in the aluminum alloy at less than or equal to about 8.0 wt %, such as from about 2.0 wt % to about 8.0 wt %, from about 2.0 wt % to about 5.0 wt %, from about 5.0 wt % to about 8.0 wt %, from about 6.0 wt % to about 8.0 wt %, or from about 7.0 wt % to about 8.0 wt %. Including cerium in the aluminum alloy may significantly increase the castability of the aluminum alloy. Including copper and cerium in the aluminum alloy at a ratio equal to about 2.0 (e.g., about 15.0 wt % Cu and about 8.0 wt % Ce) provides the aluminum alloy with good castability and improved mechanical properties at room temperature and at high temperature. The cerium may, for example, be present as $Al_{7.92}CeCu_{2.64}Mn_{0.44}$, $CeCu_4Al_8$, $CeCuAl_4$, $Al_4Ce$, or $Al_8CeMn_4$.

The manganese may be present in the aluminum alloy at less than or equal to about 2.0 wt %, such as from about 0.0 wt % to about 2.0 wt %, from about 0.0 wt % to about 0.75 wt % or from about 0.75 wt % to about 1.5 wt %.

The zirconium may be present in the aluminum alloy at less than or equal to about 0.8 wt %, such as from about 0.0 wt % to about 0.8 wt %, from about 0.0 wt % to about 0.4 wt %, or from about 0.4 wt % to about 0.6 wt %.

The scandium may be present in the aluminum alloy at from about 0.0 wt % to about 0.4 wt %, such as from about 0.0 wt % to about 0.2 wt % or from about 0.2 wt % to about 0.4 wt %.

The aluminum alloy may include a low amount or no silicon and/or iron, such as less than about 0.5% by wt % iron and/or less than about 0.4 wt % silicon. The aluminum alloy may include less than about 0.05 wt % magnesium, less than about 0.05 wt % zinc, or less than about 0.05 wt % titanium. Overall impurities in the aluminum alloy may be present at less than or equal to about 0.1 wt %.

The aluminum alloy may alternatively include from about 1 wt % to about 8 wt % cerium, lanthanum, or any combination of rare earth elements (REE), from about 2 wt % to about 15 wt % copper, from about 0 wt % to about 3 wt % manganese, from about 0 wt % to about 2 wt % zirconium, from about 0 wt % to about 2 wt % iron, from about 0 wt % to about 3 wt % magnesium, from about 0 wt % to about 3 wt % nickel, from about 0 wt % to about 5 wt % chromium, from about 0 wt % to about 0.5 wt % scandium, from about 0 wt % to about 0.5 wt % erbium, less than about 1 wt % silicon, and a balance of aluminum.

By appropriately selecting the components of the aluminum alloy and the relative amounts of the components, the aluminum alloy according to embodiments of the disclosure is formulated for use at a high temperature, such as at a temperature of up to about 425° C. The aluminum alloy may be formulated for use at from about 300° C. to about 425°

C., such as from about 300° C. to about 350° C. or from about 350° C. to about 425° C.

The aluminum alloy may be prepared from master alloys that contain no more than about 0.3 wt % impurities, such as Al-20% Ce, Al-10% Mn, Al-10% Fe, Al-2% Sc, or Al-3.5% Zr. The aluminum alloy may include about 6 wt % Cu, about 3 wt % Ce, between about 0.75 and about 1.5 wt % Mn, and between about 0.3 and about 0.8 wt % Zr, with the balance being Al. The aluminum alloy may alternatively include about 10 wt % Cu, about 5 wt % Ce, between about 0.75 wt % and about 1.5 wt % Mn, and between about 0.3 wt % and about 0.8 wt % Zr, with the balance being Al.

The aluminum alloy may, for example, include aluminum, copper, and cerium; aluminum, copper, cerium, and manganese; aluminum, copper, cerium, manganese, and zirconium; aluminum, copper, cerium, manganese, zirconium, and scandium; or aluminum, copper, cerium, manganese, zirconium, iron, silicon, magnesium, zinc, and titanium. The ratio of copper:cerium may be less than or equal to about 2.0:1.0. The relative amount of zirconium and scandium may be present according to the following expression: $0.4 \leq Zr+2*Sc \leq 0.6$. The total amount of iron, silicon, magnesium, zinc, and titanium in the aluminum alloy does not exceed (e.g., may be less than or equal to about) 0.3%.

In some embodiments, the aluminum alloy includes aluminum, cerium, copper, manganese, and zirconium (Al—Ce—Cu—Mn—Zr). In other embodiments, the aluminum alloy includes aluminum, cerium, copper, manganese, zirconium, and scandium (Al—Ce—Cu—Mn—Zr—Sc). The aluminum alloy may include from about 4.0 wt % to about 10.0 wt % copper, from about 2.0 wt % to about 5.0 wt % cerium, from about 0.5 wt % to about 1.5 wt % manganese, from about 0.4 wt % to about 0.6 wt % zirconium, and from about 0.2 wt % to about 0.3 wt % scandium, with the balance of the aluminum alloy including aluminum.

In some embodiments, the aluminum alloy includes the components in Table 1 and is referred to herein as AC-1:

TABLE 1

| Components of AC-1, in wt % (Al-balance) | | | | Impurities, not more than wt % | | | | |
|---|---|---|---|---|---|---|---|---|
| Cu | Ce | Mn | Zr | Fe | Si | Mg | Zn | Ti |
| 4.0-6.0 | 2.0-3.0 | 0.5-1.0 | 0.4-0.6 | 0.5 | 0.25 | 0.05 | 0.05 | 0.05 |

where the ratio of copper:cerium is less than or equal to 2.0:1.0, the ratio of iron:silicon is greater than or equal to 2.0:1.0, the amount of zirconium and scandium is according to the following expression: $0.4 \leq Zr+2*Sc \leq 0.6$, and the total amount of iron, silicon, magnesium, zinc, and titanium does not exceed 0.1% by mass.

The ingredients (e.g., components) may be combined and heated to form the aluminum alloy. The components may, for example, be combined and heated in an electrical resistance furnace. The components may be heated to a desired temperature and mixed, so that the other elements (e.g., the alloying elements, such as one or more of Ce, Cu, Mn, or Zr) form secondary phases in the aluminum matrix. For example, the components of the aluminum alloy may be combined at a temperature sufficient for copper to disperse in the aluminum matrix, and for zirconium and manganese, if present, to form into dispersoids, such as $Al_6Mn$, $Al_{20}Cu_2Mn_3$, $Al_3Zr$, or quaternary phases (e.g., $Al_{7.92}CeCu_{2.64}Mn_{0.44}$). If manganese is present at an amount up to about 2.0%, the manganese may enter the aluminum matrix upon solidification and may strengthen the aluminum matrix.

The copper may be distributed in the aluminum matrix. The manganese may enter the aluminum matrix upon solidification. The manganese may, for example, be present as $Al_{7.92}CeCu_{2.64}Mn_{0.44}$, $Al_6Mn$ (e.g., $Al_6Mn$ dispersoids), $Al_8CeMn_4$, or $Al_{20}Cu_2Mn_3$. By maintaining the zirconium amount at less than or equal to about 0.8 wt %, the aluminum alloy may be cast at a temperature greater than or equal to about 750° C., such as greater than or equal to about 800° C. The zirconium may, for example, be present as $Al_3Zr_L1_2$ (e.g., $Al_3Zr_Li_2$ dispersoids) or $Al_3(Zr,Sc)$. The Zr content may be adjusted to promote the formation of the $Al_{7.92}CeCu_{2.64}Mn_{0.44}$ phase. Without being bound by any theory, it is believed that the zirconium may stabilize $Al_{7.92}CeCu_{2.64}Mn_{0.44}$. If present, the scandium may, for example, be present as $Al_3Sc$ or $Al_3(Zr,Sc)$.

The aluminum alloy according to embodiments of the disclosure may be formed into individual powder particles by rapid quenching via gas atomization where the Cu, Ce, Mn, and Zr are present in amounts sufficient to provide for the intermetallic phase to include a plurality of $Al_{7.92}CeCu_{2.64}Mn_{0.44}$ (equivalent to $Al_{24}Ce_3Cu_8Mn_1$) phase in a cast component and the balance in aluminum. Gas atomization is a process used to produce metal powders by melting the metal or alloy, then transporting (e.g., forcing) the molten metal through a nozzle where it is hit by high-velocity jets of an inert gas such as nitrogen or argon. This breaks the molten metal stream into tiny droplets, which cool or "quench" rapidly in the gas environment, forming unique microstructures. The rapid quenching may lead to enhanced material properties due to the creation of non-equilibrium microstructures. The resulting solidified metal powder particles, characterized by controlled size and morphology, are then collected for further processing or use. The aluminum alloy may be atomized using nitrogen or other inert gases such as argon. The particles according to embodiments of the disclosure may range in size from about 1 μm to about 200 μm. The aluminum alloy may exhibit equivalent or better compatibility with gas atomization compared to an $Al_{10}SiMg$ alloy.

The aluminum alloy according to embodiments of the disclosure may be cast into large billets (e.g., by direct chill (DC) casting or squeeze casting) where the Cu, Ce, Mn, and Zr are present in amounts sufficient to provide for the intermetallic phase to include a plurality of $Al_{7.92}CeCu_{2.64}Mn_{0.44}$ (equivalent to $Al_{24}Ce_3Cu_8Mn_1$) phase in a cast component and the balance in aluminum. After DC casting or squeeze casting the alloy may be thermo-mechanically processed (e.g., extruded) into an article that is lightweight, has high temperature resistance and corrosion resistance, and improved mechanical properties. In DC casting, molten metal is solidified quickly by pouring it into a mold and then cooling rapidly using water or another coolant. The speed of cooling may significantly influence the material's microstructure, leading to enhanced mechanical properties. Squeeze casting involves placing (e.g., forcing) molten metal into a mold under high pressure, which reduces porosity and may improve the alloy's mechanical and physical properties. The aluminum alloy may show greater retention of strength at temperatures above 200° C. compared to aluminum 2618-T6, which includes Cu: 1.9%-2.7%; Fe: 0.9%-1.2%; Ni: 0.9%-1.2%; Si: 0.5%-1.2%; Mn: 0.6%-1.2%; Ti: 0.04%-0.2%; and Mg: 1.3%-1.8%. The article is formed and may be used without conducting a heat treatment act, such as without conducting a solution heat treatment and quench. However, the article may be further strengthened by conducting an optional heat treatment act. The resulting article formed from the aluminum alloy may exhibit minimal defects (e.g., minimal porosity and shrinkage).

A method of forming an article from the aluminum alloy may include melting the aluminum alloy and fabricating the article by sand, permanent mold, die, or direct chill casting where the Cu, Ce, Mn, and Zr are present in amounts sufficient to achieve a plurality of $Al_{7.92}CeCu_{2.64}Mn_{0.44}$ (equivalent to $Al_{24}Ce_3Cu_8Mn_1$) particles dispersed in an Al-based matrix. The article may be thermomechanically processed by rolling, swaging, forging, or extrusion at a temperature ranging from about 25° C. to about 500° C. The article may be heated to from about 300° C. to about 350° C. for from about 1 hour to about 10 hours and annealed at from about 400° C. to about 450° C. for from about 0.5 hour to about 10 hours. The article may be heated to from about 400° C. to about 450° C. for from about 0.5 hour to about 10 hours, quenched in water or oil and, optionally, annealed at from about 180° C. to about 300° C. for from about 0.5 hour to about 10 hours. $Al_{20}Cu_2M_{n3}$ particles may form in an aluminum-based matrix with dimensions of between about 10 nm and about 300 nm.

The aluminum alloy according to embodiments of the disclosure may be more castable than other aluminum alloys, such as A336 or A319, which are conventional aluminum alloys formulated for casting. The aluminum alloy according to embodiments of the disclosure may be cast at a temperature of from about 750° C. to about 950° C., such as from about 750° C. to about 800° C., from about 800° C. to about 850° C., from about 850° C. to about 900° C., or from about 900° C. to about 950° C. The casting temperature may depend upon the concentration of Zr in the alloy: at about 0.6% Zr the casting temperature is greater than or equal to (e.g., not lower than) about 850° C.; at about 0.4% Zr the casting temperature is greater than or equal to (e.g., not lower than) about 800° C.; at about 0.2% Zr the casting temperature is greater than or equal to (e.g., not lower than) about 750° C. Metal treatment operations (e.g., an argon blowing treatment) may be conducted at the same temperatures as the casting. The solidification cooling rate may be greater than or equal to about 3 K/s, which may be achieved using thin-wall metallic molds (e.g., with a wall not thicker than about 20 mm).

The amount of cerium, amount of zirconium, amount of manganese, and amount of copper present in the aluminum alloy may be sufficient to cause the formation of the $Al_{7.92}CeCu_{2.64}Mn_{0.44}$ (equivalent to $Al_{24}Ce_3Cu_8Mn_1$) as the plurality intermetallic phase in an aluminum-based matrix. The aluminum alloy may include Cu and Ce in a ratio of 2:1 (wt %) where Cu may be from about 4 wt % to about 10 wt % and Ce may be from about 2 wt % to about 5 wt %. The Mn content may be from about 0.5 wt % to about 2 wt % to promote the formation of the $Al_{7.92}CeCu_{2.64}Mn_{0.44}$ (equivalent to $Al_{24}Ce_3Cu_8Mn_1$) eutectic phase. The zirconium content may be from about 0.2 wt % to about 1.0 wt % to promote the formation of the $Al_{7.92}CeCu_{2.64}Mn_{0.44}$ (equivalent to $Al_{24}Ce_3Cu_8Mn_1$) eutectic phase. The Ce content may be from about 2 wt % to about 6 wt %.

The fabricated article may include a heterogeneous microstructure having an aluminum-based matrix phase and an intermetallic phase. The aluminum-based matrix phase further includes isolated features with an average length of from about 100 nm to about 50 μm. The intermetallic phase may further include a lathe or cellular-like structure between the aluminum-based matrix with a thickness ranging from about 10 nm to about 10 μm. The microstructure may include eutectic $Al_{7.92}CeCu_{2.64}Mn_{0.44}$ (equivalent to $Al_{24}Ce_3Cu_8Mn_1$) as the plurality of the intermetallic phase in the microstructure. The microstructure may contain a lesser fraction of one of the following: $Al_2Cu$, $Al_{11}Ce_3$ or $Al_8Cu_4Ce$, in addition to the $Al_{7.92}CeCu_{2.64}Mn_{0.44}$ (equivalent to $Al_{24}Ce_3Cu_8Mn_1$) phase. The aluminum-based matrix may further include manganese, copper, and/or zirconium in a solid solution.

The cast or atomized alloys (either pressed or sealed in a container) may be subject to thermomechanical processing via rolling, swaging, forging, or extrusion at a temperature ranging from about 25° C. to about 500° C.

The cast and/or thermomechanically processed article may, optionally, be heat treated, such as in a gas or electric furnace (annealing) or in a drying box (artificial aging). The article may, for example, be subjected to a first heat treatment act at a temperature of from about 300° C. to about 350° C. for an amount of time ranging from about 3 hours to about 10 hours, such as at a temperature of from about 300° C. to about 320° C. for an amount of time ranging from about 3 hours to about 10 hours. The article may then be subjected to a second heat treatment act at a temperature of from about 400° C. to about 450° C. for an amount of time ranging from about 3 to about 10 hours, such as at a temperature of from about 400° C. to about 420° C. for an amount of time ranging from about 3 to about 10 hours. The heat treatment act may be a T4 treatment, or a T6 treatment. However, the article may be used without conducting a solution heat treat and quench act.

The cast article and/or thermomechanically processed article may, optionally, be heat treated, such as in a gas or electric furnace (annealing) or in a drying box (artificial aging). The article may, for example, be subjected to a first heat treatment act at a temperature of from about 400° C. to about 450° C. for an amount of time ranging from about 1 hours to about 10 hours, such as at a temperature of from about 420° C. to about 440° C. for an amount of time ranging from about 1 hours to about 10 hours. The article may be quenched (e.g., quenched in water or oil) following this first heat treatment. The article may then be subjected to a second heat treatment act at a temperature of from about 180° C. to about 300° C. for an amount of time ranging from about 1 to about 10 hours, such as at a temperature of from about 200° C. to about 250° C. for an amount of time ranging from about 1 to about 10 hours. The heat treatment act may be a T4 treatment or a T6 treatment. This heat treatment may result in $Al_{20}Cu_2Mn_3$ precipitates forming with a smaller fraction of $Al_2Cu$ precipitates possible.

The article formed from the aluminum alloy according to embodiments of the disclosure and formed as described above may exhibit the following desirable properties at 25° C. after heat treatment (T4 or T6 temper): a yield strength of greater than 175 MPa and a hardness greater than 80 HBR. The article formed from the aluminum alloy may also exhibit at 250° C.: YS>93 MPa.

The article formed from the aluminum alloy according to embodiments of the disclosure and formed as described above following thermo-mechanical processing, for example extrusion at 200° C. with reduction ratio of 5:1 may exhibit the following mechanical properties: for 25° C., YS greater than 250 MPa and total elongation of greater than 7%; for 200° C., YS greater of 170 MPa and total elongation greater than 20%; for 300° C., YS greater than 100 MPa and total elongation greater than 20%.

The article formed from the aluminum alloy according to embodiments of the disclosure and formed as described above following thermomechanical processing, for example extrusion at 300° C. with reduction ratio of 5:1 may exhibit the following mechanical properties after 140 hours of thermal exposure at 410° C.: for 25° C., YS greater than 195 MPa and total elongation greater than 12%; for 200° C., YS greater of 140 MPa and total elongation greater than 20%; for 300° C., YS greater than 70 MPa and total elongation greater than 25%.

The aluminum alloy according to embodiments of the disclosure and articles formed from the aluminum alloy may be used in the automotive industry, the aerospace industry, or other industries where light-weight aluminum alloys and/or composites are desired. For instance, the aluminum alloy may be used in engine pistons, aircraft electrical wiring, or light armor. The aluminum alloy may be usable at a high temperature (e.g., at from about 300° C. to about 350° C. or from about 350° C. up to about 425° C.). The need to operate at higher temperatures is dictated by the fundamental thermodynamic principles. For aerospace and automotive alloys, the temperature of long-term performance exceeds 300° C. or even 350° C. Conventional aluminum alloys such as A336 and A339 do not satisfy these conditions since their castability and hot cracking index are very low.

Example

An Al—Ce—Cu—Mn—Zr—Sc aluminum foundry alloy (referred to as AC-1 herein) was developed with excellent castability (better than alloys A336 or A339). No solution heat treatment and quench were used with the AC-1, and the AC-1 was used after a T4 treatment. Following casting and T4 treatment at 350° C. for 10 hours, AC-1 had the following properties at 25° C.: UTS>260 MPA; YS>190 MPa; Elongation El>6-8%; hardness>80 HV; 100-hour strength at 300° C.: YS>70-80 MPa; 100-hour strength at 350° C.: YS>30-40 MPa.

AC-1 was prepared in an electrical resistance furnace. AC-1 had the following chemical composition: from about 4 to about 6 wt. % Cu; from about 2 to about 3 wt. % Ce; from about 0.5 to about 1.0 wt. % Mn; from about 0.4 to about 0.6 wt. % Zr; and from about 0.2 to about 0.3 wt. % Sc. The ratio of Cu to Ce was less than or equal to about 2.0; and the amounts of Zr and Sc were according to the following equation: $0.4 \leq (Zr+2*Sc) \leq 0.6$.

AC-1 included not more than the following amount of impurities: less than or equal to about 0.5 wt. % Fe; less than or equal to about 0.4 wt. % Si; less than or equal to about 0.05 wt. % Mg; less than or equal to about 0.05 wt. % Zn; and less than or equal to about 0.05 wt. % Ti. The overall content of all impurities did not exceed about 0.1%; and the ratio of Fe to Si was less than or equal to about 2.0. The following primary components were used: Al about 99.7% purity; Cu about 99.9% purity; binary master alloys of Al with Ce, Mn, Zr, and Sc. The following master alloys were used: Al-20% Ce; Al-10% Mn; Al-3.5% Zr; Al-2% Sc.

FIG. 1 shows an X-ray diffraction (XRD) pattern of an as-cast Al-6Cu-3Ce-1Mn-0.5Zr alloy, revealing peaks corresponding to Al, $Al_2Cu$, $Al_{7.92}CeCu_{2.64}Mn_{0.44}$, and $Al_8Cu_4Ce_0$ phases.

Figure 2A:
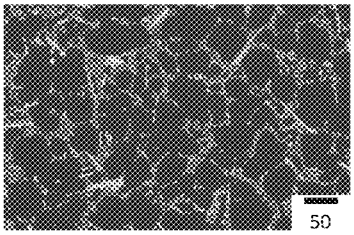
FIGS. 2A and 2B are SEM micrographs of Al-6Cu-3Ce-1Mn-0.5Zr alloys according to embodiments of the disclosure.
Figure 2B:
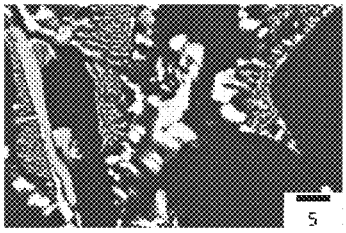

FIGS. 2A-2B are micrographic images of Al-6Cu-3Ce-1Mn-0.5Zr alloys fabricated via casting into ingot trays to replicate slow cooling at about 0.2° C./sec. FIGS. 2A and 2B show electron microscopy micrographs obtained at different regions within the alloy. Energy-Dispersive X-ray Spectroscopy (EDS) maps (not shown) were obtained for the material shown in FIG. 2B, and showed the alloy elements of Al, Ce, Cu, Mn, and Zr. The microstructure revealed a dendritic microstructure and intermetallic compounds composed of Al—Ce—Cu—Mn and Al—Ce—Cu. Based on XRD results, the phases were identified as $Al_{7.92}CeCu_{2.64}Mn_{0.44}$ and $Al_8Cu_4Ce$ phases, respectively. The microhardness of the cast alloy was measured to be about 83.6 Hv.

FIGS. 3A1-3D2 are low-magnification and high-magnification back-scattered SEM micrographs. FIGS. 3A1 and 3A2 show as-cast Al-6Cu-3Ce-1Mn-0.5Zr alloys fabricated via injection casting. FIGS. 3B1 and 3B2 show the alloys annealed at about 300° C. for 1 hour; FIGS. 3C1 and 3C2 show the alloys annealed at about 400° C. for 1 hour; and FIGS. 3D1 and 3D2 show the samples annealed at about 500° C. for 1 hour. FIGS. 3A-3D highlight the thermal stability of an Al-6Cu-3Ce-1Mn-0.5Zr alloy prepared by injection casting into ½" diameter Cu mold. The microstructure revealed that injection cast alloys had comparable dendritic microstructure and microstructure at eutectic regions to their counterparts prepared at equilibrium conditions. The nominally cubic $Al_{7.92}CeCu_{2.64}Mn_{0.44}$ structures, which may display tetragonal distortion based on composition, mostly remained intact prior to exposure to temperatures below about 500° C. Exposure to about 500° C. for 1 hour led to fragmentation without apparent structural coarsening. High-density nanosized precipitation took place within primary Al regions, which may be assigned to $Al_{20}Cu_2Mn_3$ and $Al_2Cu$.

Figure 4:
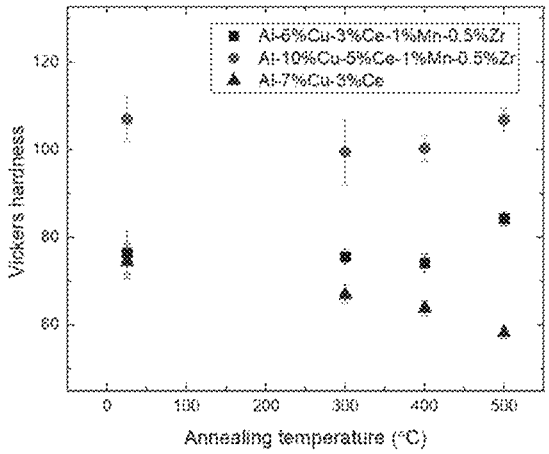
FIG. 4 is a graph of Vickers hardness as a function of annealing temperature of Al-6Cu-3Ce-1Mn-0.5Zr alloys, Al-10Cu-5Ce-1Mn-0.5Zr alloys, and Al-7Cu-3Ce alloys according to embodiments of the disclosure.

FIG. 4 is a graph of the evolution of Vickers hardness of Al-6Cu-3Ce-1Mn-0.5Zr, Al-10Cu-5Ce-1Mn-0.5Zr, and Al-7Cu-3Ce alloys, fabricated via injection casting, as a function of annealing temperature. The ternary Al-7Cu-3Ce alloy with a eutectic tetragonal $Al_8Cu_4Ce$ phase experienced a decrease in hardness as a result of $Al_8Cu_4Ce$ coarsening. In contrast, both the Al-6Cu-3Ce-1Mn-0.5Zr and Al-10Cu-5Ce-1Mn-0.5Zr alloys exhibited greatly enhanced thermal stability and underwent a hardness increase upon exposure to 500° C. due to new precipitations of $Al_{20}Cu_2Mn_3$ and $Al_2Cu$ phases.

Figure 5A:
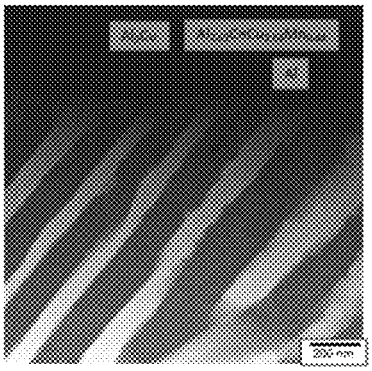
FIGS. 5A-5B are TEM micrographs and STEM micrographs of as-cast Al-6Cu-3Ce-1Mn-0.5Zr alloys according to embodiments of the disclosure.
Figure 5B:
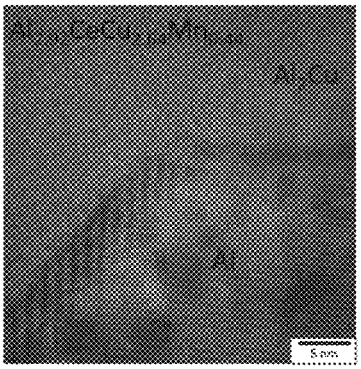

FIGS. 5A-5B show transmission electron microscopy (TEM) and scanning transmission electron microscopy (STEM) of as-cast Al-6Cu-3Ce-1Mn-0.5Zr alloy fabricated via injection casting. FIG. 5A shows a low-magnification STEM micrograph of the Al-6Cu-3Ce-1Mn-0.5Zr alloy and highlights that cubic $Al_{7.92}CeCu_{2.64}Mn_{0.44}$ had fine lamellar structure with an average thickness of 100 nm and $Al_2Cu$ nanoprecipitates tended to be affixed to $Al_{7.92}CeCu_{2.64}Mn_{0.44}$ lamellae, giving rise to triple junctions demonstrated in FIG. 5B. FIG. 5B shows a mediate magnification TEM image of a typical triple junction composed of Al, $Al_{7.92}CeCu_{2.64}Mn_{0.44}$ and $Al_2Cu$ phases. Analytical measurements showed that the cubic $Al_{7.92}CeCu_{2.64}Mn_{0.44}$ phase had an A1:Cu:Ce ratio similar to that of a conventional tetragonal $Al_8Cu_4Ce$ phase but contained Mn and Zr.

Figure 6A:
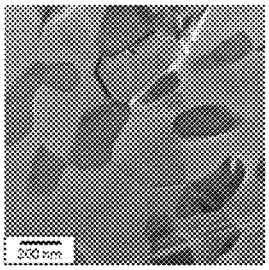
FIGS. 6A-6D are TEM micrographs of Al-6Cu-3Ce-1Mn-0.5Zr alloys according to embodiments of the disclosure.
Figure 6B:
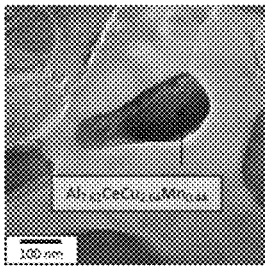
Figure 6C:
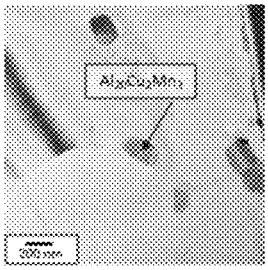
Figure 6D:
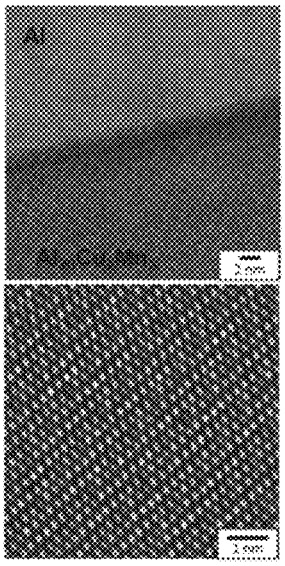

FIGS. 6A-6D show TEM results of the Al-6Cu-3Ce-1Mn-0.5Zr alloy after annealing at about 500° C. for 1 hour. FIGS. 6A-6C show low-magnification TEM micrographs of eutectic region and Al matrix, respectively. FIG. 6D shows high resolution TEM images of the interface structure between Al and $Al_{20}Cu_2Mn_3$ as well as the atomic structure of $Al_{20}Cu_2Mn_3$. FIGS. 6A and 6B show that the cubic $Al_{7.92}CeCu_{2.64}Mn_{0.44}$ phase at eutectic regions went through a fragmentation process after annealing at 500° C. for 1 hour without obvious coarsening. Meanwhile, high-density grain boundaries were identified in the Al phase at eutectic regions, suggestive of a recrystallization process within eutectic regions. FIG. 6C shows high-density nanoprecipitations generated in the Al matrix. According to analytical observations and high-resolution TEM analyses, these nanoprecipitates may be assigned to the $Al_{20}Cu_2Mn_3$ phase. In addition, some $Al_2Cu$ nanoparticles were observed. EDS maps (not shown) were obtained for the material and showed the alloy elements of Al, Cu and Mn in the Al matrix.

Figure 7:
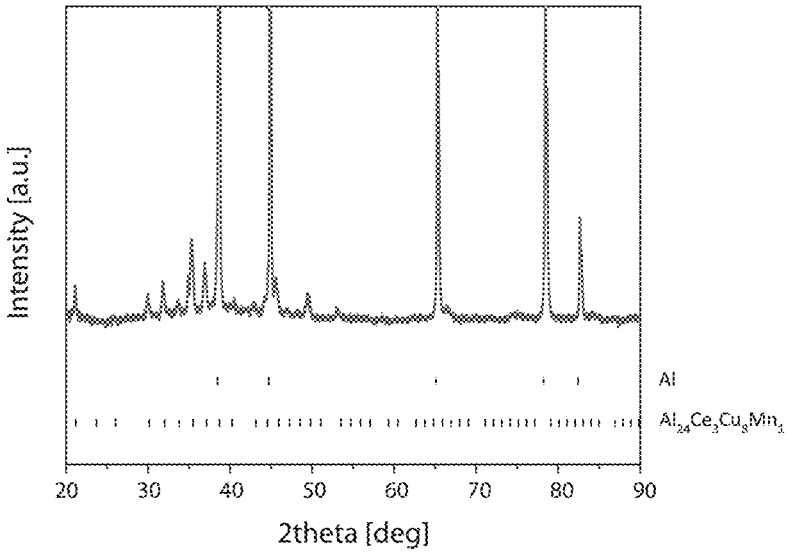
FIG. 7 are X-ray diffraction spectra of atomized Al-6Cu-3Ce-1Mn-0.5Zr alloy powders according to embodiments of the disclosure.
Figure 8A:
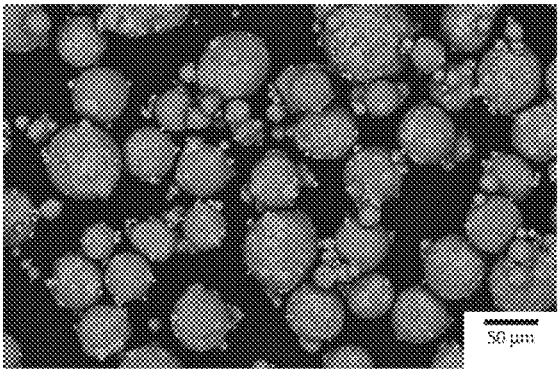
FIGS. 8A-8C are STEM micrographs of atomized Al-6Cu-3Ce-1Mn-0.5Zr alloy powders according to embodiments of the disclosure.
Figure 8B:
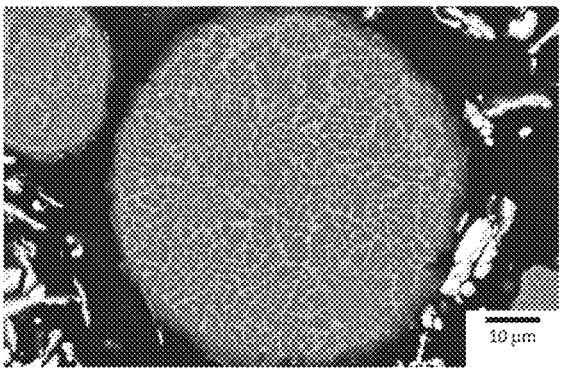
Figure 8C:
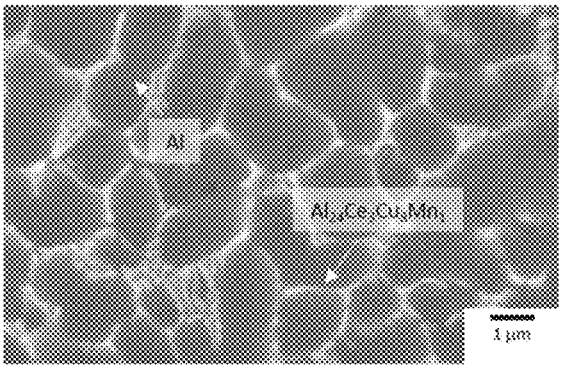

FIG. 7 shows an XRD pattern of atomized Al-6Cu-3Ce-1Mn-0.5Zr alloy powders, revealing peaks corresponding to Al and $Al_{24}Ce_3Cu_8Mn_1$ phases. The morphology and microstructures of the atomized powders are shown in FIGS. 8A-8C. The powder particles had a diameter of about 45 μm to about 125 μm. The microstructure showed fine precipitates of $Al_{24}Ce_3Cu_8Mn_1$ within the powders.

FIGS. 8A-8C are scanning electron microscopy micrographs of the atomized Al-6Cu-3Ce-1Mn-0.5Zr alloy powders. The microstructure of FIG. 8C showed fine precipitates of $Al_{24}Ce_3Cu_8Mn_1$ within an Al-rich matrix.

Figure 9A:
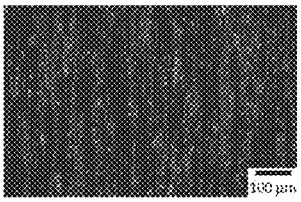
FIGS. 9A and 9B are SEM micrographs of Al-6Cu-3Ce-1Mn-0.5Zr alloys according to embodiments of the disclosure.
Figure 9B:
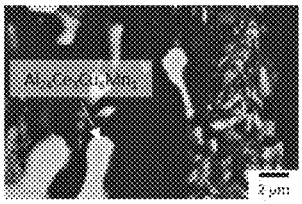

FIGS. 9A and 9B show images of Al-6Cu-3Ce-1Mn-0.5Zr alloys extruded at 200° C. with reduction ratio of 5:1 from the cast alloys of FIG. 2. FIGS. 9A and 9B are scanning electron microscopy micrographs obtained at different regions within the alloys. EDS maps (not shown) were obtained for the material, and showed the alloy elements of Al, Ce, Cu, Mn, and Zr. The microstructure was aligned with the extrusion direction and shows $Al_{24}Ce_3Cu_8Mn_1$ precipitates. The microhardness of the extruded alloy was measured to be about 92.1 Hv.

Figure 10A:
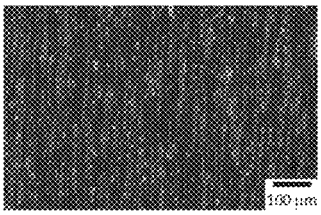
FIGS. 10A and 10B are SEM micrographs of Al-6Cu-3Ce-1Mn-0.5Zr alloys according to embodiments of the disclosure.
Figure 10B:
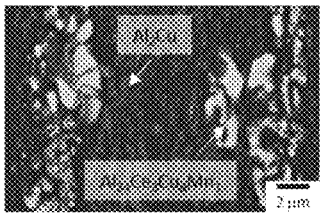

FIGS. 10A and 10B show images of Al-6Cu-3Ce-1Mn-0.5Zr alloys extruded at 300° C. with reduction ratio of 5:1 from the cast alloys of FIG. 2. FIGS. 10A and 10B are scanning electron microscopy micrographs obtained at different regions within the alloy. EDS maps (not shown) were obtained for the material, and showed the alloy elements of Al, Ce, Cu, Mn, and Zr. The microstructure was aligned with extrusion direction and presents $Al_{24}Ce_3Cu_8Mn_1$ precipitates. Fine $Al_2Cu$ was additionally precipitated in the Al matrix. The microhardness of the extruded alloy was measured to be about 76.9 Hv.

Figure 11:
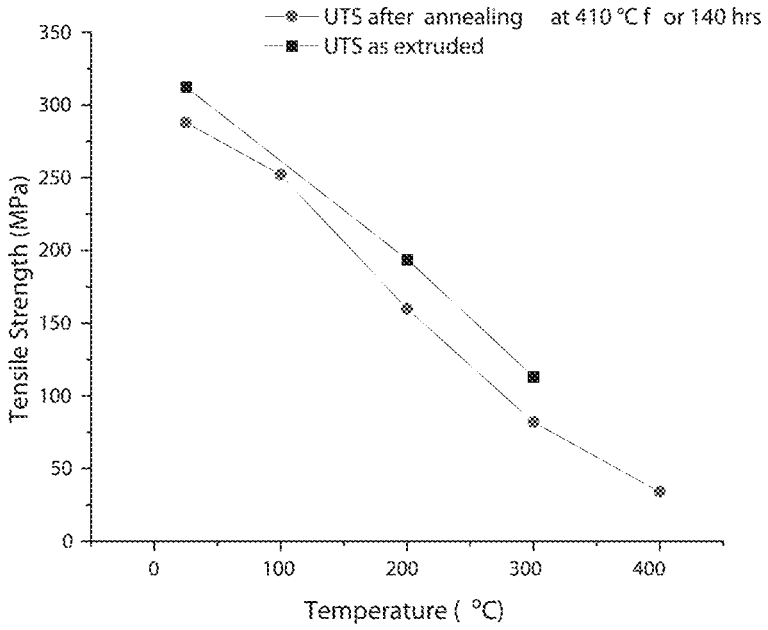
FIG. 11 is a graph of ultimate tensile strength as a function of temperature of Al-6Cu-3Ce-1Mn-0.5Zr alloys according to embodiments of the disclosure.

FIG. 11 shows ultimate tensile strength as a function of temperature for an Al-6Cu-3Ce-1Mn-0.5Zr alloy extruded at 300° C. with reduction ratio of 5:1 from the cast alloy shown in FIG. 2. The results are for alloys tested in uniaxial tension at $\sim 1\times10^{-4}s^{-1}$. The values represented by squares correspond to extruded ingot that was annealed at 410° C. for 140 hours and the circles represent ingot that was extruded. The small decrease in UTS for the annealed samples highlights the thermal stability of the Al-6Cu-3Ce-1Mn-0.5Zr alloy.

Figure 12:
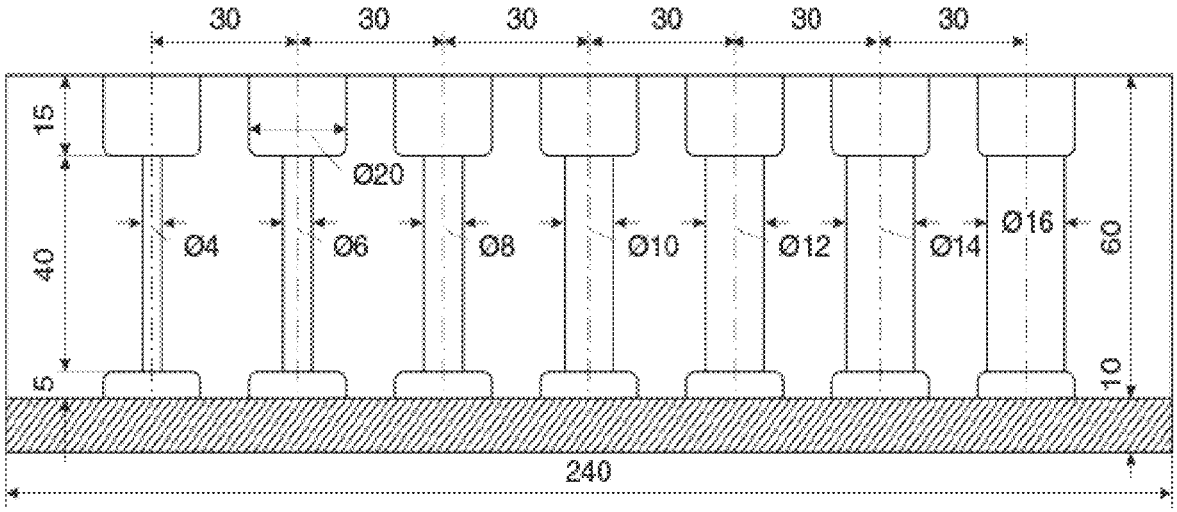
FIG. 12 is a schematic of a pencil probe for hot cracking.
Figure 13:
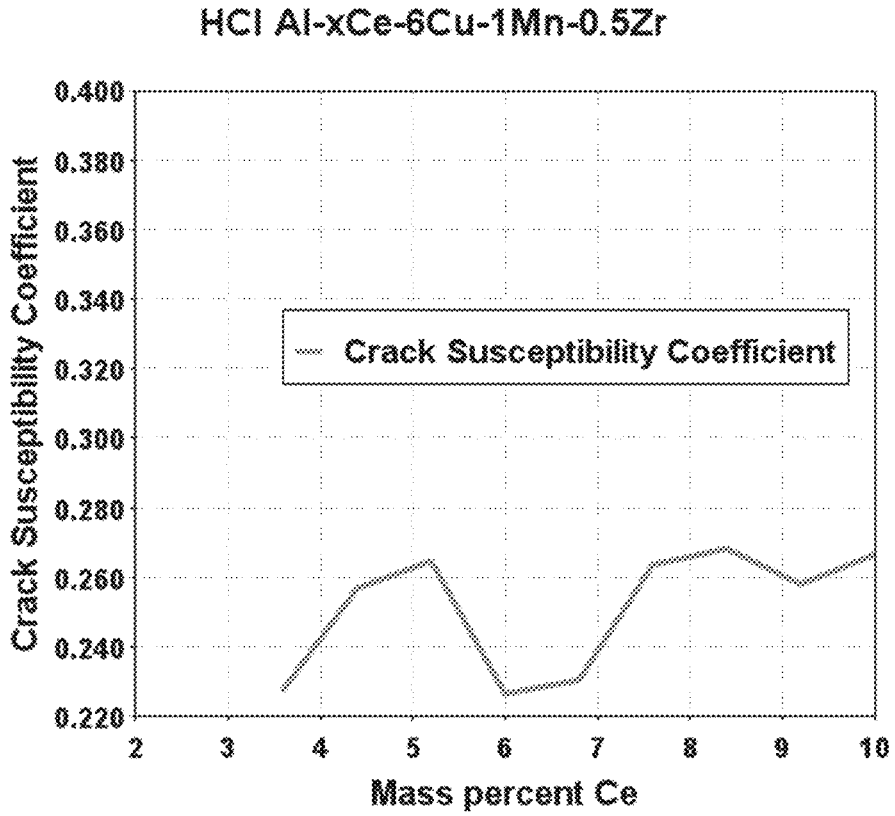
FIG. 13 shows the hot crack susceptivity coefficient of the alloy according to embodiments of the disclosure calculated using Thermo-Calc models.

An estimate of hot cracking tendency was conducted using a pencil probe, shown in FIG. 12. The minimal sample diameter, at which there were no cracks, was taken as a measure of hot pre-solidification cracking. Additionally, standard shape casting called "automobile pump frame" was used, which possesses high rigidity and gives a possibility to assess not only hot cracking tendency, but also how completely molten metal filled the shape. Thermal analysis was conducted using a thermocouple positioned in molten alloy with a mass of 50 mg. The AC-1 alloy composition was tested for good castability as a function of the Ce concentration. The Thermo-Calc castability model was employed. The results are presented in FIG. 13.

Figure 14A:
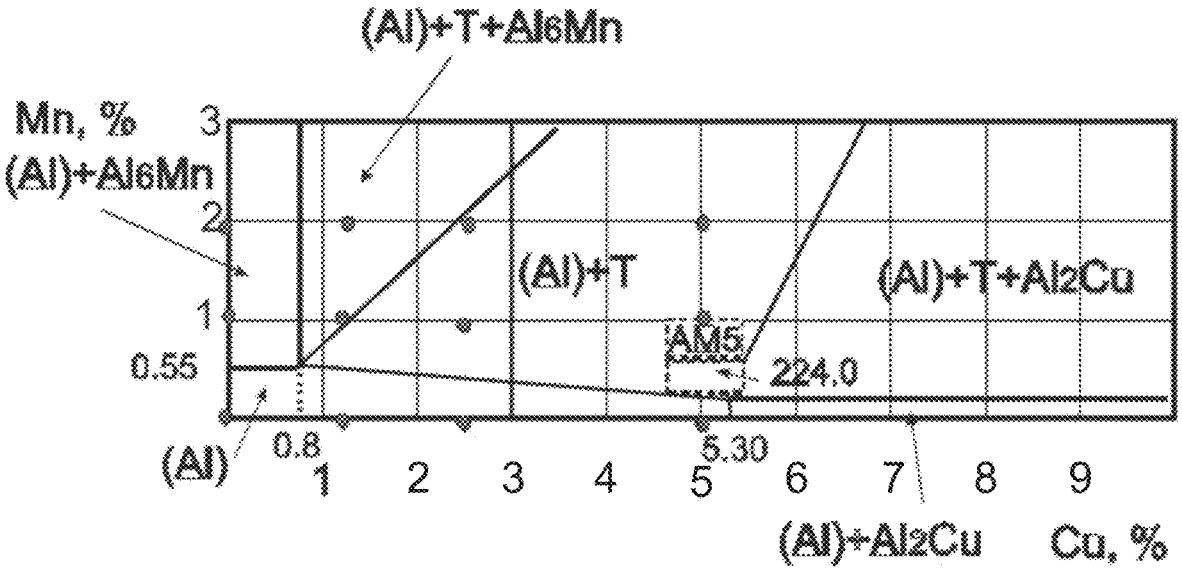
FIGS. 14A-14B show an Al—Cu—Mn phase diagram at 540° C. and 450° C. according to embodiments of the disclosure.
Figure 14B:
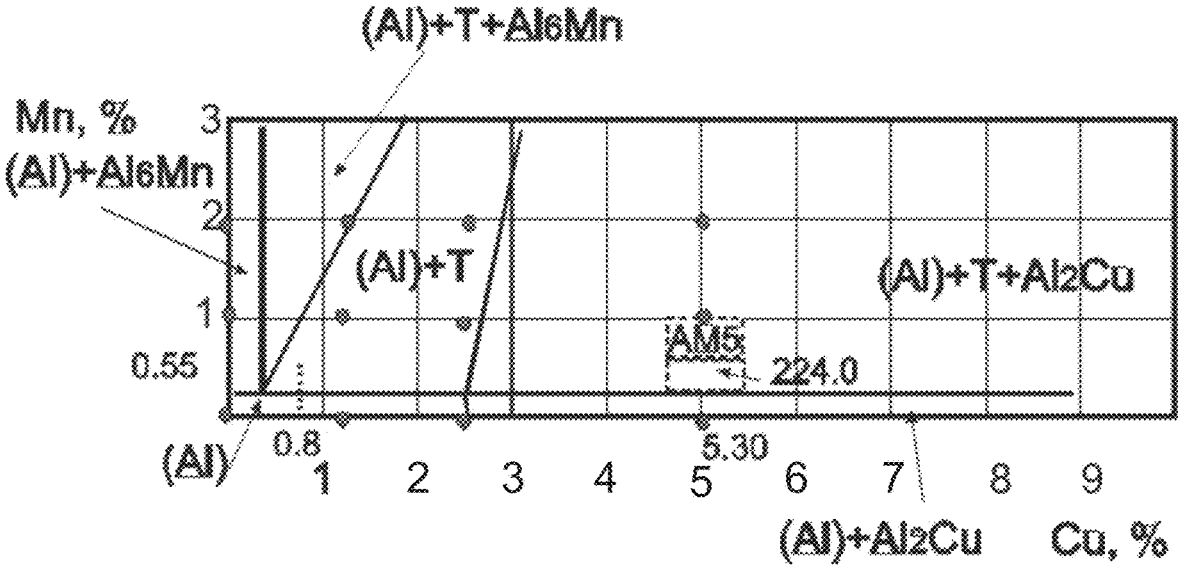
Figure 15A:
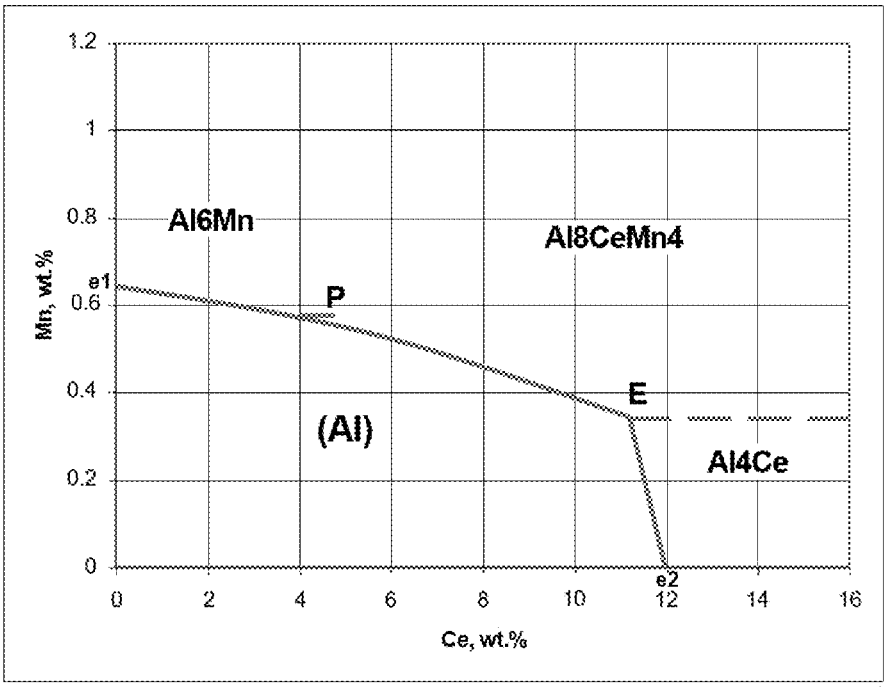
FIGS. 15A-15B show Al—Ce—Mn phase diagrams according to embodiments of the disclosure.
Figure 15B:
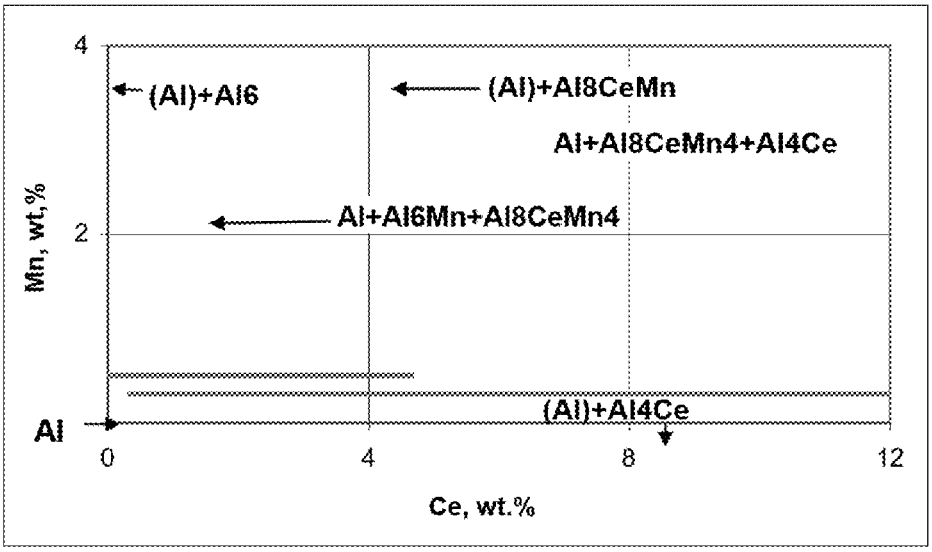
Figure 16A:
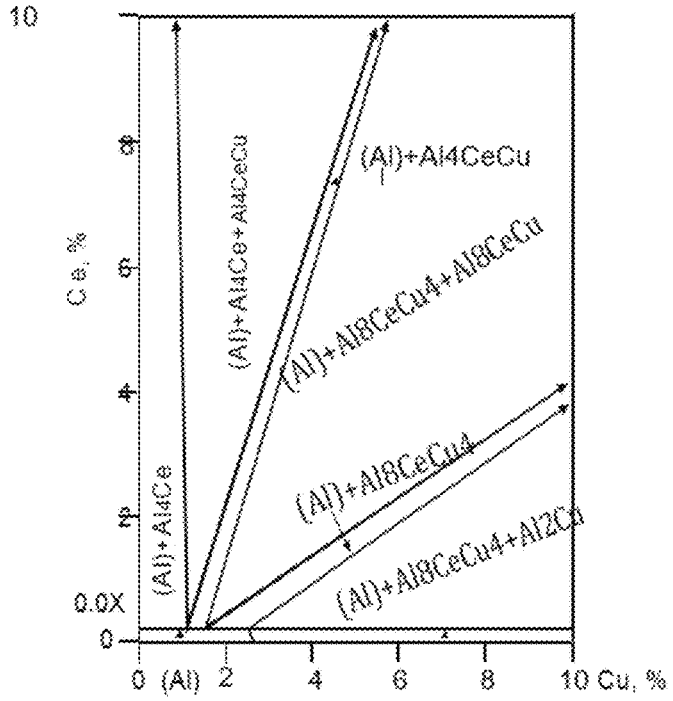
FIGS. 16A-16B show Al—Cu—Ce phase diagrams according to embodiments of the disclosure.
Figure 16B:
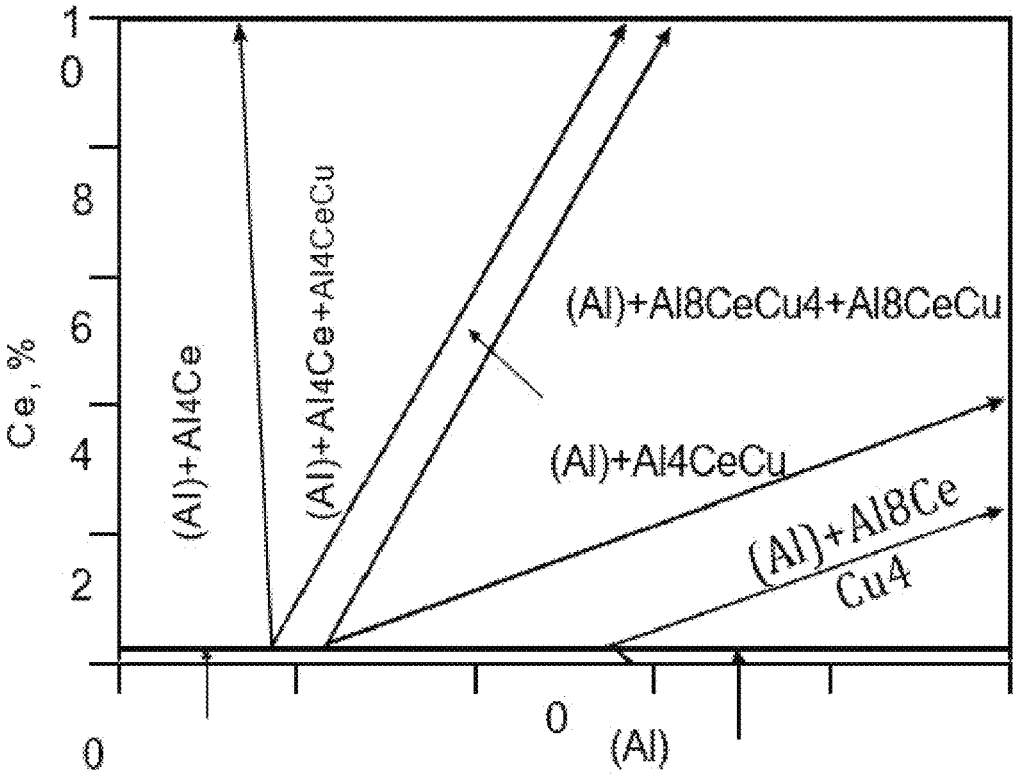

A fragment of the Al—Cu—Ce—Mn phase diagram was constructed in the Al-corner. FIGS. 14A-14B show experimental alloys and their positions on isothermal cross-sections of the Al—Cu—Mn phase diagram at 540° C. (FIG. 14A) and at 450° C. (FIG. 14B). FIGS. 15A-15B show the aluminum corner of the Al—Ce—Mn phase diagram. FIG. 15A shows the liquidus line and FIG. 15B shows the isothermal cross-section at 450° C. FIGS. 16A-16B show isothermal cross sections of the Al—Cu—Ce diagram at 450° C. (FIG. 16A) and at 540° C. (FIG. 16B). It was demonstrated that (Al) in quaternary alloys was in equilibrium with 6 phases: $Al_2Cu$, $Al_6Mn$, $Al_4Ce$, $Al_{20}Cu_2Mn_3$, ($CeCu_4Al_8$ and $Al_8CeMn_4$) and $CeCuAl_4$. Additionally, phases $Al_6Mn$ and $Al_{20}Cu_2Mn_3$ were present in alloys as dispersoids.

Figure 17:
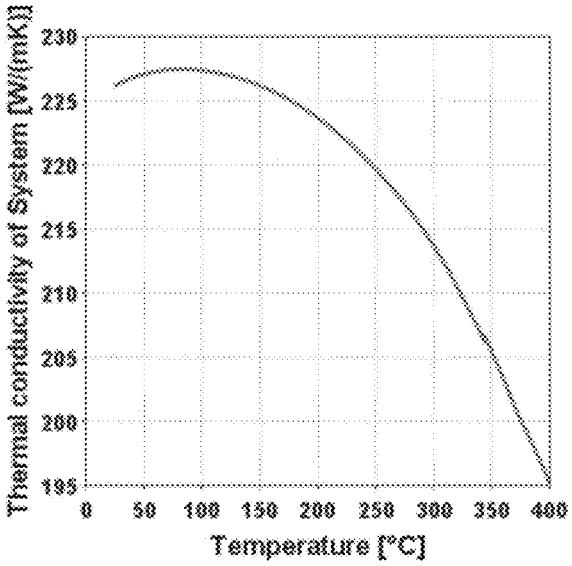
FIG. 17 shows the thermal conductivity of an Al-3Ce-6Cu-1Mn-0.5Zr alloy according to embodiments of the disclosure.

The thermal conductivity of AC-1 was explored computationally, and the results are presented in FIG. 17. AC-1 had high thermal conductivity at temperatures of from about 50° C. to about 400° C.

Figure 18A:
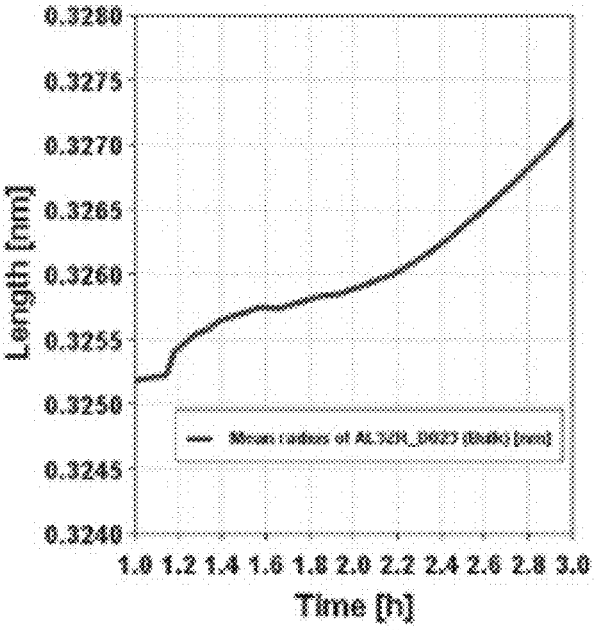
FIGS. 18A-18B show precipitation modeling at 350° C. according to embodiments of the disclosure.
Figure 18B:
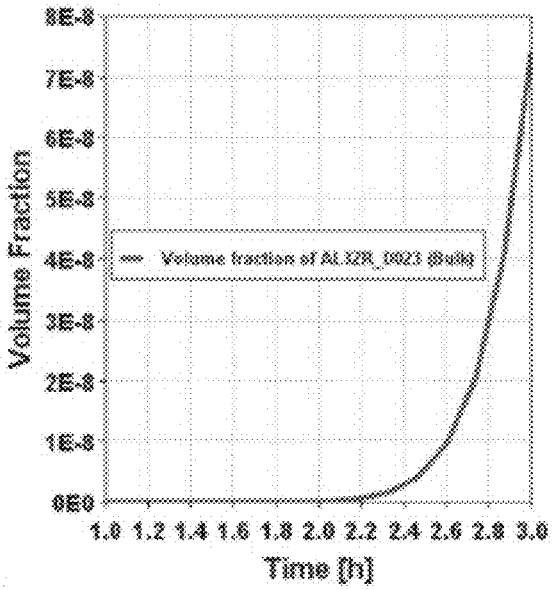
Figure 19A:
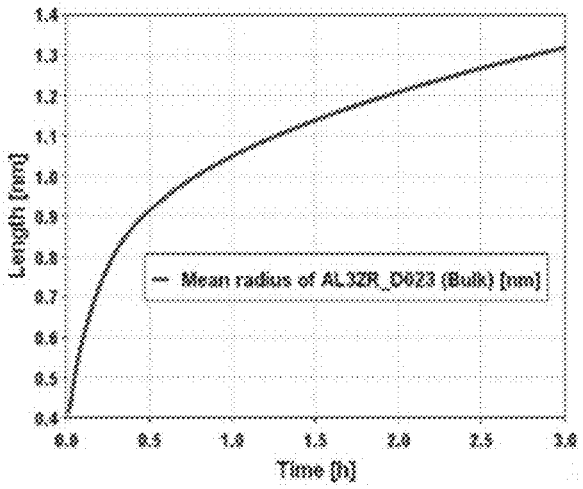
FIGS. 19A-19B show precipitation modeling at 450° C. according to embodiments of the disclosure.
Figure 19B:
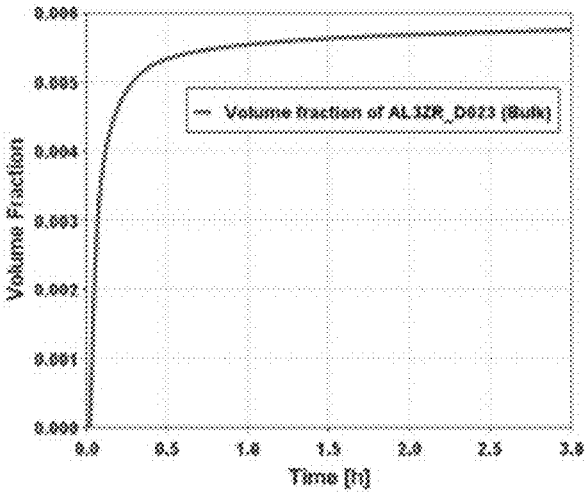

The conditions for a two-stage heat treatment regime (e.g., $1^{st}$ stage for 3 hours to 10 hours at 300° C.-320° C.; $2^{nd}$ stage for 3 hours to 10 hours at 400° C.-420° C.) were identified using precipitation modeling with TCAL6 and MOBAL5 thermodynamic and mobility databases. The results for annealing for 3 hours at 350° C. are depicted in FIGS. 18A-18B. An anneal temperature of 350° C., while resulting in micro-segregation elimination and stabilization of the microstructure, did not yield $Al_3Zr$_L12 precipitates in sufficient amounts and of desired size. The results for a second stage of annealing for 3 hours at 450° C. are depicted in FIGS. 19A-19B. This resulted in about 100% precipitation of the available $Al_3Zr$, and the particle size was about 2 nm.

Figure 20A:
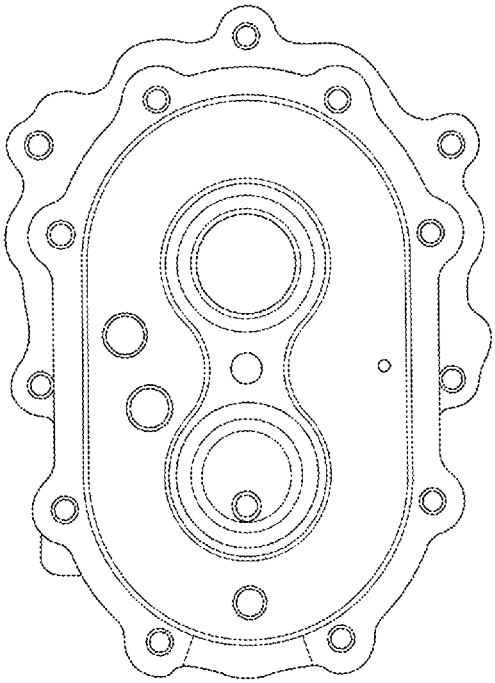
FIGS. 20A-20B show an article from two different viewpoints cast with an Al-3Ce-6Cu-1Mn-0.5Zr alloy according to embodiments of the disclosure.
Figure 20B:
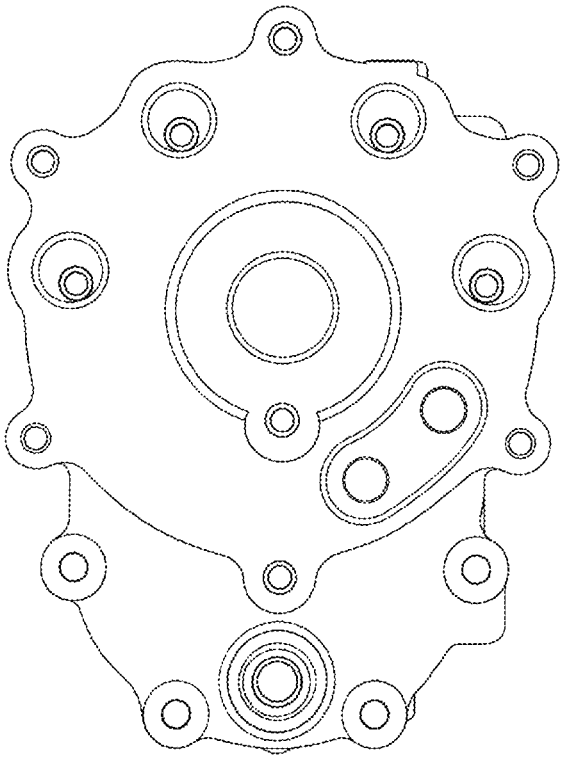
Figure 21:
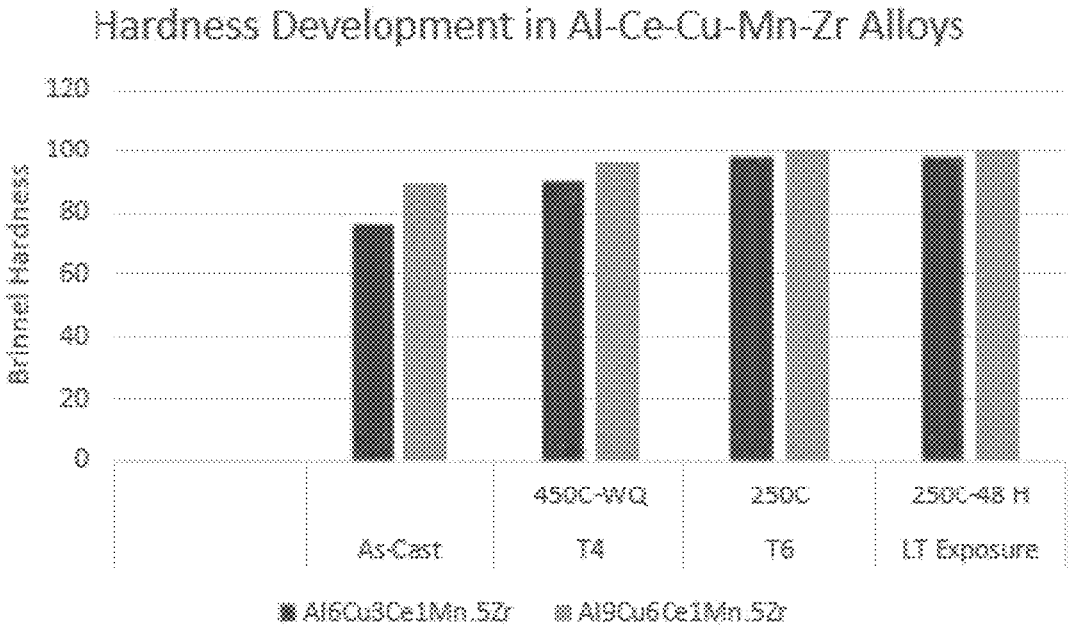
FIG. 21 is a graph of the Brinell hardness of the article of FIGS. 21A-21B according to embodiments of the disclosure.

The composition of casting alloy described herein is characterized by considerable advantages when compared to existing Al—Mg—Si casting alloys. The AC-1 alloy composition was used to cast an article, shown in FIGS. 20A-20B. The Brinell hardness of the article as-cast, after a T4 treatment, after a T6 treatment, and after exposure to 250° C. for 48 hours is shown in FIG. 21. At each treatment, the hardness of the A16Cu3Ce1Mn·5Zr alloy was comparable to the hardness of the Al9Cu6Ce1Mn·5Zr alloy.

A comparative analysis of the chemical composition of AC-1 and conventional alloys used to form industrial pistons is shown in Table 2:

TABLE 2

| Alloy Name* | Si, % | Ni, % | Cu, % | Mg, % | Fe, % | Mn, % |
|---|---|---|---|---|---|---|
| AlSi12MnMgNi | 11-13 | 0.8-1.3 | 0.8-1.5 | 0.7-1.3 | 0.7 | 0.2 |
| AlSi12Mn2MgNi | 11-13 | 0.8-1.3 | 1.5-3.0 | 0.7-1.3 | 0.8 | 0.3-0.6 |
| AlSi18 | 17-19 | 0.8-1.3 | 0.8-1.5 | 0.8-1.3 | 0.5 | 0.2 |
| AA393.0 | 21-23 | 2.0-2.5 | 0.7-1.1 | 0.7-1.3 | 1.3 | 0.1 |
| AA336.0 | 11-13 | 2.0-3.0 | 0.5-1.5 | 0.7-1.3 | 1.2 | 0.35 |
| AA339.1 | 11-13 | 0.5-1.5 | 1.5-3.0 | 0.6-1.5 | 0.9 | 0.5 |
| FM 109 | 11.5-12.5 | 0.8-1.1 | 0.9-1.3 | 1.1-1.3 | 0.5 | 0.05-0.2 |
| FM 113 | 11.5-12.5 | 0.8-1.2 | 3.0-3.3 | 0.9-1.2 | 0.35 | 0.15 |
| FM 135 | 12.7-13.7 | 0.8-1.2 | 4.8-5.3 | 0.9-1.2 | 0.35 | 0.1 |
| FM 120 | 12.0-13.5 | 0.7-1.3 | 0.8-1.5 | 0.9-1.3 | 0.65 | 0.05-0.3 |
| FM 180 | 17.0-19.0 | 0.8-1.3 | 0.8-1.5 | 0.8-1.3 | 0.57 | 0.05-0.2 |

TABLE 2-continued

| Alloy Name* | Si, % | Ni, % | Cu, % | Mg, % | Fe, % | Mn, % |
|---|---|---|---|---|---|---|
| FM S2N | 11.4-12.4 | 2.1-2.5 | 3.1-3.5 | 0.6-1.0 | 0.4 | 0.15 |
| FM S2 | 11.0-12.0 | 2.3-2.8 | 3.3-3.8 | 0.6-0.9 | 0.5 | 0.15-0.25 |
| FM BI | 12.5-13.5 | 2.3-2.8 | 4.9-5.4 | 0.6-0.9 | 0.5 | 0.15-0.25 |
| FM B2 | 12.2-12.6 | 2.7-3.0 | 3.9-4.3 | 0.6-0.9 | 0.5 | 0.15 |
| AC-1 | <0.25 | 2.0-3.0Ce | 4.0-6.0 | 0.4-0.6Zr | <0.5 | 0.5-1.0 |

*Russian alloys according to GOST 1583-93 and GOST 30620-98, AA-specification of Aluminum Association (USA), FM-specification of Federal-Mogul Corporation Powertrain Systems An overwhelming majority of alloys in this class are Si-bearing alloys, more specifically, the Al—Si—Cu—Mg—Ni system. Depending upon the silicon contents and their microstructures, the Si-bearing alloys are divided into two major groups: alloys close to eutectic (10%-14% Si) and hyper-eutectic alloys (17%-23% Si). Since all these alloys contain copper and magnesium, their solidification completes at temperatures of 503° C.-505° C., which corresponds to eutectics with participation of $Al_2Cu$ and $Al_5Cu_2Mg_8Si_6$. Only when the concentration of Cu exceeds 1.5% may the solidus temperature be higher. Furthermore, since the liquidus temperature of these alloys is usually higher than 600° C., they are characterized by a broad solidification range and, as a consequence, only average castability (markedly worse than that of AA356). The fact that AC-1 was characterized by a narrow solidification range implies that it is more castable than conventional industrial piston alloys, even with low concentrations of copper and cerium. Experimental data on castability, shown in Table 3, confirmed this conclusion.

T4 temper engine piston Si-bearing alloys have a UTS not higher than 250 MPa and very low elongation (E1<1%), which is comparable to the mechanical properties of AC-1 at room temperature. However, after several hours of work at 300° C.-350° C. the advantage of AC-1 became apparent. In AC-1, the aluminum matrix is strengthened by dispersoids and possesses high thermal stability (at least up to 425° C.). On the other hand, in industrial alloys containing Cu— and Mg-bearing phases ($Mg_2Si$, $Al_2Cu$, and $Al_5Cu_2Mg_8Si_6$) a coarsening process takes place, which inevitably results in the degradation of properties at such temperatures. This shortcoming of Si-bearing alloys cannot be eliminated in principle.

Another important advantage of AC-1 is its higher thermal stability at high temperatures (e.g., temperatures greater than about 300° C.). According to data provided in Table 3, alloys of the 336 type at 350° C. have at least two times lower long-term strength compared to AC-1:

TABLE 3

| | AC-1 | AA336 |
|---|---|---|
| Casting technique | Mold casting | Mold Casting |
| Heat treatment | T4 + stabilization at 350° C. | T4 + stabilization at 350° C. |
| Long-term strength (UTS), MPa | 280-300 | 200-220 |
| Relative elongation (El), % | 6-7 | <1 |
| Brinell hardness | 80-90 | 75-90 |
| 100-strength | | |
| at 250° C., Mpa | 80-85 | N/A |
| at 350° C., Mpa | 30-35 | <20 |

TABLE 3-continued

| | AC-1 | AA336 |
|---|---|---|
| Fatigue limit ($10^7$ cycles), Mpa, at 20° C. | 115-120 | 90-95 |
| Density, g/cm$^3$ | 2.8 | 2.7 |
| Hot cracking index, mm | 6 (very good) | 10-12 (average to less than average) |

While eutectic Si-bearing casting alloys containing large amounts of Si possessed somewhat better thermal stability compared to AA336, they were difficult to manufacture from a technological standpoint, with casting temperatures well in excess of 800° C. Additionally, AC-1 possessed much better fatigue resistance, as may be seen in Table 3. No significant differences in corrosion resistance exist between AC-1 and AA339.

Table 4 shows the mechanical properties of alloys of the Al—Ce—Cu—Mn—Zr system after heat treatment (3 hours at 350° C.+3 hours at 450° C.):

TABLE 4

| Concentration in alloy, % | | | | Mechanical properties | |
|---|---|---|---|---|---|
| Cu | Ce | Zr | Mn | $\sigma_B$, Mpa | δ, % |
| — | 2.5 | 0.6 | — | 170 | 14 |
| — | 2.5 | 0.6 | 1 | 224 | 9 |
| 2.5 | 2.5 | 0.6 | — | 267 | 10 |
| 2.5 | 2.5 | 0.6 | 1 | 275 | 9.5 |
| 5 | 2.5 | 0.6 | 1 | 301 | 6 |

The inclusion of 1% Mn in AC-1 increased strength substantially compared to AA336, while retaining elongation at sufficiently high levels. The introduction of 2.5% Cu rendered an even more pronounced effect. The maximal strength was attained in the alloy containing 5% Cu, while elongation was still satisfactory.

Samples of AC-1 were prepared for standard testing for 100-hour hardness (tensile testing) and also high-cycle fatigue testing at room temperature and at 250° C. Table 5 shows the results of standard testing for 100 hours hardness at elevated temperatures:

TABLE 5

| Alloy | Heat treatment | Testing temperature, ° C. | Applied stress, Mpa | Time to fracture, hours |
|---|---|---|---|---|
| Al-2.5% Ce-5% Cu-1% Mn-0.6% Zr | 350° C., 3 hours + +450° C., 3 hours | 250 | 70 | >100* |
| | | 250 | 75 | >100* |
| | | 250 | 100 | 11 |
| | | 350 | 30 | >100* |
| | | 350 | 40 | 30 |

*testing was stopped because samples did not break (no fracture)

Table 6 shows the results of fatigue testing of AC-1 at room and elevated temperatures:

TABLE 6

| Testing parameters | 20° C. | | | 250° C. | | |
|---|---|---|---|---|---|---|
| Stress, MPa | 130 | 115 | 100 | 90 | 70 | 60 |
| # of cycles to fracture | 448400 | $>10^7$ * | $>10^7$ * | 501700 | 7601200 | $>10^7$ * |

*testing stopped, no fracture

These results demonstrate the advantages of AC-1 when compared to conventional alloys.

Solidification of Al—Cu—Ce alloys was modeled systematically. It was shown that additions of Ce resulted in significant narrowing of the solidification range and, consequently, improved castability of Al—Cu alloys, if solidification ends by a high-temperature (610° C.) eutectic reaction ($L \rightarrow (Al)+CeCu_4Al_8$), i.e., no non-equilibrium eutectic reactions with the participation of $Al_2Cu$ take place, which in industrial Al—Cu alloys without Ce occurs at about 548° C. The eutectic $(Al)+CeCu_4Al_8$ was highly dispersed and may be spheroidized and/or fragmented during heating-up to about 540° C. and higher. Even after annealing at 590° average particle size(s) of ternary compounds did not exceed from about 1 μm to about 2 μm compared to from about 5 μm to about 20 μm for the $Al_2Cu$ phase after heat treatment at 540° C. This exerted very beneficial influence upon the aluminum alloy's thermal stability and strength.

The influence of ancillary additions of Zr and Sc upon the microstructure and hardening of Al—Ce—Cu—Mn alloys was modeled. Zirconium was introduced in the amounts of from about 0.4% to about 0.6%, which imposed limitations upon casting temperature—not lower than about 800° C. for 0.4% Zr and about 850° C. for 0.6% Zr. Two-step aging of castings (300° C.-320° C.)+(400° C.-420° C.) with time(s) of exposure of 3-10 hours on each step were used.

It was demonstrated with solidification and phase equilibria modeling that casting temperature could be lowered to about 750° C. and total heat treatment time reduced to 3 hours if Sc in the amounts of from about 0.1 wt % to about 0.15 wt % is introduced, as long as the following rule is obeyed: $0.4 \leq (Zr+2*Sc) \leq 0.6$.

Quality assessment of as-cast and heat-treated articles may be conducted using microstructure analysis and Brinell hardness (e.g., by loading a 250 kg ball with a diameter 5 mm and exposure time of 30 seconds). Final evaluation of casting quality may be determined by tensile mechanical testing; the level of properties should correspond to those given in Table 3. Tensile mechanical properties should be measured according to ASTM standards using cylindrical samples (e.g., with a diameter of from about 3 mm to about 6 mm).

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. An aluminum alloy consisting of aluminum, copper, cerium, manganese, zirconium, and a total impurity content of less than or equal to about 0.1% by weight, the aluminum alloy comprising a copper: cerium ratio of about 2.0:1.0.

2. The aluminum alloy of claim 1, wherein the aluminum alloy consists of from about 3.0% by weight (wt %) to about 15.0 wt % copper, from about 2.0 wt % to about 8.0 wt % cerium, from about 0.1 wt % to about 2.0 wt % manganese, and from about 0.1 wt % to about 0.8 wt % zirconium.

3. The aluminum alloy of claim 1, wherein the copper is present at a concentration of from about 4.0 wt % to about 10.0 wt % and the cerium is present at a concentration of from about 2.0 wt % to about 5.0 wt %.

4. The aluminum alloy of claim 1, wherein the manganese is present at a concentration of from about 0.5 wt % to about 2 wt %, the zirconium is present at a concentration of from about 0.2 wt % to about 1.0 wt %, and the cerium is present at a concentration of from about 2 wt % to about 6 wt %.

5. The aluminum alloy of claim 1, wherein the copper is present at a concentration of about 6.0 wt %, the cerium is present at a concentration of about 3.0 wt %, the manganese is present at a concentration of from about 0.75 wt % to about 1.5 wt %, and the zirconium is present at a concentration of from about 0.3 wt % to about 0.8 wt %.

6. The aluminum alloy of claim 1, wherein the copper is present at a concentration of about 10 wt %, the cerium is present at a concentration of about 5 wt %, the manganese is present at a concentration of from about 0.75 to about 1.5 wt %, and the zirconium is present at a concentration of from about 0.3 to about 0.8 wt %.

7. The aluminum alloy of claim 1, wherein the aluminum is present at a concentration of greater than or equal to about 85 wt %.

8. An aluminum article consisting of aluminum, copper, cerium, scandium, and one or more of manganese and zirconium, the aluminum article having a total impurity content of less than or equal to about 0.1% by weight and exhibiting a heterogeneous microstructure.

9. The aluminum article of claim 8, wherein the heterogeneous microstructure comprises one or more of an $Al_{7.92}CeCu_{2.64}Mn_{0.44}$ eutectic phase, an $Al_{20}Cu_2Mn_3$ phase, an $Al_2Cu$ phase, an $Al_{11}Ce_3$ phase, an $Al_6Mn$ phase, a $CeCu_4Al_8$ phase, an $Al_8CeMn_4$ phase, a $CeCuAl_4$ phase, or an $Al_8Cu_4Ce$ phase.

10. The aluminum article of claim 8, wherein $Al_{7.92}CeCu_{2.64}Mn_{0.44}$ particles are dispersed in an aluminum matrix of the aluminum article.

11. The aluminum article of claim 8, wherein $Al_{20}Cu_2Mn_3$ particles exhibiting dimensions of from about 10 nm to about 300 nm are dispersed in an aluminum matrix of the aluminum article.

12. The aluminum article of claim 8, wherein the aluminum article comprises manganese, copper, or zirconium in solid solution.

13. A method of forming an aluminum article, comprising:

combining aluminum, copper, cerium, scandium, and one or more of manganese and zirconium to form an aluminum alloy mixture;

heating the aluminum alloy mixture to form a molten aluminum alloy; and casting the molten aluminum alloy into a mold of an article, the article consisting of the aluminum, the copper, the cerium, the scandium, and the one or more of manganese and zirconium, the article having a total impurity content of less than or equal to about 0.1% by weight and exhibiting a heterogeneous microstructure.

14. The method of claim 13, wherein combining aluminum, copper, cerium, and one or more of manganese and zirconium to form an aluminum alloy mixture comprises using one or more of Al-20% Ce, Al-10% Mn, Al-10% Fe, Al-2% Sc, or Al-3.5% Zr as a master alloy.

15. The method of claim 13, wherein casting the molten aluminum alloy comprises casting the molten aluminum alloy at a temperature of from about 750° C. to about 950° C.

16. The method of claim 13, wherein casting the molten aluminum alloy comprises gravity casting, die casting, or direct chill casting the molten aluminum alloy.

17. The method of claim 13, further comprising conducting a heat treatment on the aluminum article after casting the molten aluminum alloy.

* * * * *